US008622014B2

(12) United States Patent
Lundberg

(10) Patent No.: US 8,622,014 B2
(45) Date of Patent: Jan. 7, 2014

(54) CABLE CONNECTION SYSTEM FOR UNDERWATER VEHICLE

(75) Inventor: Lars Lundberg, Motala (SE)

(73) Assignee: SAAB AB, Linköping (SE)

( * ) Notice: Subject to any disclaimer, the term of this patent is extended or adjusted under 35 U.S.C. 154(b) by 71 days.

(21) Appl. No.: 13/145,818

(22) PCT Filed: Jan. 22, 2009

(86) PCT No.: PCT/EP2009/050721

§ 371 (c)(1),
(2), (4) Date: Sep. 29, 2011

(87) PCT Pub. No.: WO2010/083885

PCT Pub. Date: Jul. 29, 2010

(65) Prior Publication Data

US 2012/0006245 A1 Jan. 12, 2012

(51) Int. Cl.
*B63G 8/00* (2006.01)

(52) U.S. Cl.
USPC ..... 114/312

(58) Field of Classification Search
USPC ..... 114/312
See application file for complete search history.

(56) References Cited

U.S. PATENT DOCUMENTS 3,955,522 A * 5/1976 Gaudiano et al. ..... 114/259
5,291,194 A * 3/1994 Ames ..... 340/850
5,349,916 A 9/1994 Hillenbrand et al.
5,748,102 A 5/1998 Barron
6,600,695 B1 * 7/2003 Nugent et al. ..... 367/131
6,928,947 B1 * 8/2005 Clapham ..... 114/312
7,992,682 B2 * 8/2011 Ziaylek ..... 182/127

OTHER PUBLICATIONS

PCT/ISA/210—International Search Report—December 9, 2009.
PCT/ISA/237—Written Opinion of the International Searching Authority—December 9, 2009.
PCT/IPEA/409—International Preliminary Report on Patentability—April 5, 2011.

* cited by examiner

*Primary Examiner* — Stephen Avila
(74) *Attorney, Agent, or Firm* — Venable LLP; Eric J. Franklin

(57) ABSTRACT

A system for interconnecting a mother ship with a submersible vehicle using a cable towed by the mother ship. The cable has a first cable end connected to the mother ship and a second cable end to be connected to the submersible vehicle. The second cable end is provided with a first connector. A capturing mast is arranged at the submersible vehicle for capturing the cable towed by the mother ship. A connector holder is arranged at the submersible vehicle for holding the first connector when it is to be connected to a second connector. The second connector is connected to the submersible vehicle. A first guide is arranged at the submersible vehicle for guiding the first connector towards the connector holder of the submersible vehicle. A second guide turns the connector to a well defined position into the connector holder.

19 Claims, 12 Drawing Sheets

CABLE CONNECTION SYSTEM FOR UNDERWATER VEHICLE

CROSS-REFERENCE TO RELATED APPLICATIONS

This application is the national phase under 35 U.S.C. §371 of PCT/EP2009/050721 filed 22 Jan. 2009.

TECHNICAL FIELD

The present invention relates to a system for interconnecting a mother ship with a submersible vehicle, using a cable towed by the mother ship, the cable having a first cable end connected to the mother ship, and a second cable end to be connected to the submersible vehicle.

BACKGROUND

U.S. Pat. No. 5,748,102 disclose an apparatus for interconnecting an unmanned underwater vehicle and a free floating communications pod.

SUMMARY OF THE INVENTION

The inventors have realised that thee is a need within the field of submersible vehicles, in particular autonomous underwater vehicles (AUVs) and unmanned underwater vehicles (UUVs), and even unmanned surface vehicle (USV), to be able to be recharged without having to take them ashore, or aboard or alongside a mother ship to connect manually to a power cable or the like. There is also a need to be able to upload data via high speed data link, e.g. via an optical fibre connection, to said submersible vehicle. In addition, sometimes there is an need to operate an AUV in a more conventional way, that is, operation by having real time communication with, and by having power supplied by, a surface mother ship.

Therefore, it is an object of the present invention to provide a system for enabling an underwater vehicle to capture a cable towed by a mother ship, to find a first connector at an end of said cable, and to connect said connector to a second connector being part of said underwater vehicle. When the cable is connected, this enables for example for the transmission of electrical power to recharge batteries of the unmanned underwater vehicle. In one embodiment the first connector has an oval cross section. In another embodiment the connector has a circular cross section. The UUV is provided with a capturing mast, preferably arranged to be moveable, even more preferred it is arranged to be foldable, and being arranged to capture the cable during a manoeuvre wherein the UUV is travelling largely transversally to the lengthwise direction of the cable. The capturing mast is preferably arranged to fold due to the cable pulling forces and the driving force of the swimming UUV. Alternatively, a force transducer can be arranged to sense a pulling force affecting the capturing mast, and a motor or servo arrangement can be arranged to fold the capturing mast when the sensed pulling force exceeds a certain value. When a foldable capturing mast folds from an upright position to a folded position the cable follows and comes closer to an upper surface of the UUV. The cable also comes closer to a first guiding frame of a particular shape. As the cable runs in the first guiding frame, eventually the cable end together with the connector will be guided down to a connector cradle having guiding structures wherein the connector, due to the oval shape, turns into a predetermined position to enable the second connector to be linearly moved by the help of an actuator, and establish electrical contact by connecting the second connector with the first connector.

Thus, according to a first aspect there is provided a submersible vehicle having means for connecting to a cable in water having a first cable end with a first connector to be connected to the submersible vehicle, the submersible vehicle comprises:

a capturing mast;

a first guiding means;

a connector holder;

wherein the capturing mast is adapted to capture the cable and guide the cable towards the first guiding means;

the first guiding means is adapted to guide the first connector towards the connector holder;

the connector holder is adapted to hold the first connector when it is to be connected to a second connector.

The submersible vehicle may further comprise:

second guiding means for turning the connector to a predefined position into the connector holder.

The capturing mast is preferably moveable, and even foldable.

The first guiding means is a preferably a guiding frame. The second guiding means is preferably a guiding frame.

The submersible vehicle further comprises an actuator arranged at the submersible vehicle for moving the second connector, towards the first connector to establish connection between the mother ship and the submersible vehicle.

The actuator is preferably a linear actuator arranged at the submersible vehicle for linearly moving the second connector, towards the first connector to establish connection between the mother ship and the submersible vehicle.

The capturing mast is preferably arranged at a distance from the longitudinal midline of the submersible vehicle and at a front half portion of the submersible vehicle.

The first guiding means is arranged near a horizontal midline and at a rear half portion of the submersible vehicle.

The submersible vehicle has an upper side mainly free of protruding objects except for the capturing mast and the guiding means.

The first guiding means comprises a first and a second member, the first member is arranged to guide the cable downwards and sideways towards the second guiding frame, and the second member is arranged to guide the cable mainly in sideways direction towards the second guiding frame.

The submersible vehicle may be provided with a hook organ arranged at a top portion of the capturing mast.

The hook organ may be partly ring shaped for surrounding the cable, and has an opening for letting the cable into space defined by the hook organ, as an alternative, the hook organ is a principally a straight member arranged with an angle towards a main portion of the mast.

According to a second aspect there is provided a system for interconnecting a mother ship with a submersible vehicle, using a cable towed by the mother ship, the cable having a first cable end connected to the mother ship, and a second cable end to be connected to the submersible vehicle, the second cable end being provided with a first connector, the system comprising:

a capturing mast arranged at the submersible vehicle for capturing the cable towed by the mother ship;

a connector holder being arranged at the submersible vehicle for holding the first connector when it is to be connected to a second connector, the second connector being connected to the submersible vehicle;

first guiding means being arranged at the submersible vehicle for guiding the first connector towards the connector holder of the submersible vehicle;

second guiding means for turning the connector to a predefined position into the connector holder.

According to a third aspect there is provided a method for connecting a towed cable to a submersible vehicle, the cable having a second cable end connectable to an entity, and a first cable end to be connected to the submersible vehicle, the first cable end being provided with a first connector, the method comprising the following steps:

capturing the cable with the aid of a capturing mast arranged at the submersible vehicle;

guiding the cable towards first guiding means with the aid of the capturing mast guiding the first connector towards a connector holder of the submersible vehicle with the aid of first guiding means;

holding the first connector with the aid of the connector holder which holder is adapted to hold the connector firmly in the predefined position where it can be connected to a second connector, the second connector being connected to the submersible vehicle;

moving the second connector towards the first connector.

The method may further comprise the step of:

turning the connector to a predefined position into the connector holder.

Described embodiments discloses features that enable handling of rotationally dependent connectors, i.e., connectors that must be rotated into a particular position to be able to connect, just like many normal domestic connectors. If so rotationally independent connectors, i.e., connectors which do not need to be in a certain rotational position to enable connection, were used, the design of the embodiments could of course be simplified. On the market today there is a wider supply of rotationally dependent connectors having a wide range of specifications concerning maximum current, water resistance etc., and therefore it is desirable to not having to be forced to use rotationally independent connectors.

It should be emphasized that the term "comprises/comprising" when used in this specification is taken to specify the presence of stated features, integers, steps or components but does not preclude the presence or addition of one or more other features, elements, integers, steps, components or groups thereof.

Features that are described and/or illustrated with respect to one embodiment may be used in the same way or in a similar way in one or more other embodiments and/or in combination with or instead of the features of the other embodiments.

BRIEF DESCRIPTION OF THE DRAWINGS

Preferred embodiments will be explained below with the aid of enclosed drawings, of which

DETAILED DESCRIPTION

Figure 1:
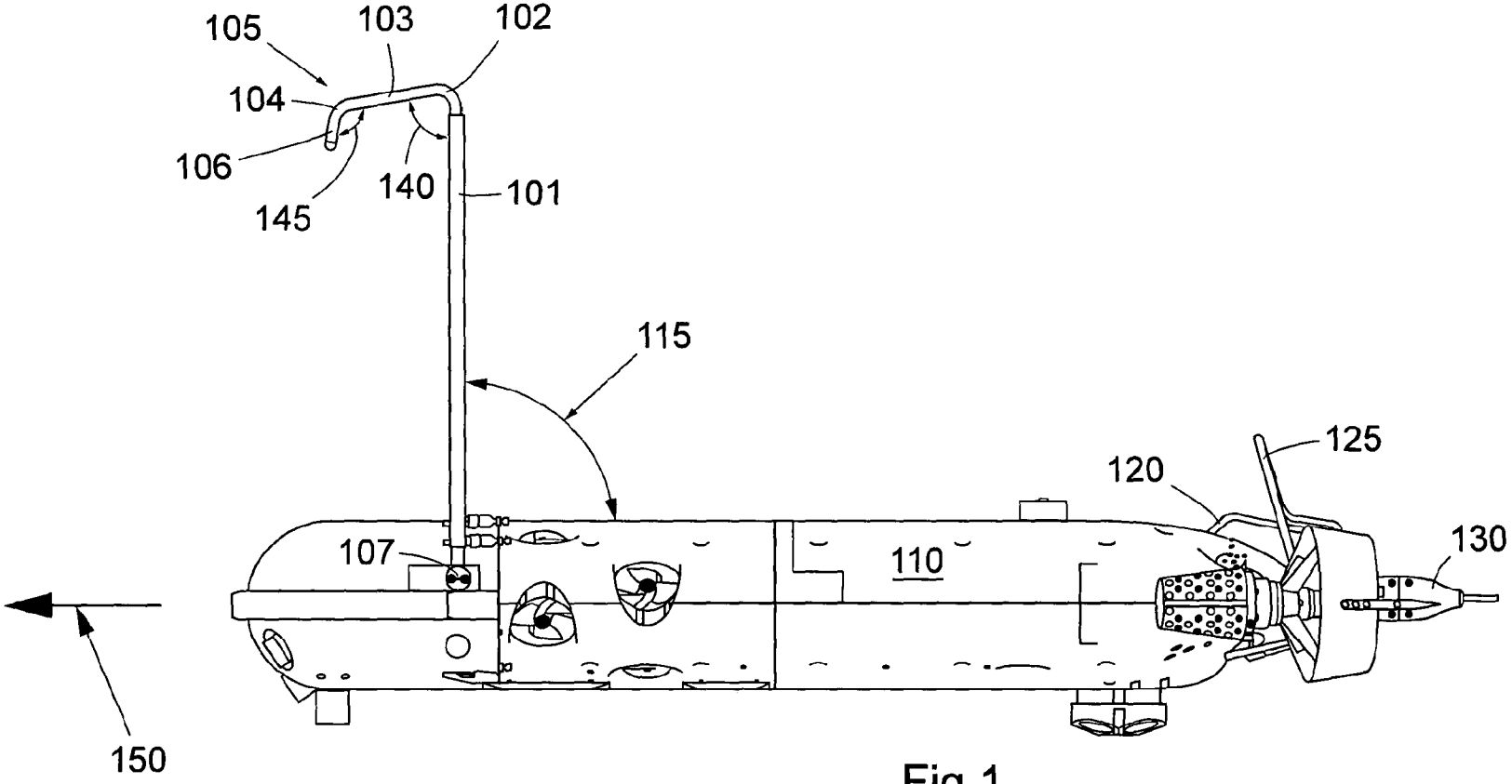
FIG. 1 shows a side view of an UUV with means of a first embodiment for capturing a towed cable and connecting to a connector at an end of said cable.

FIG. 1 shows a side view of an UUV 110 with means for capturing a towed cable and connecting to a connector at an end of said cable. A foldable capturing mast 105 is arranged at a side of the UUV 110, and is foldable around a pivoting point 107.

The foldable capturing mast 105 can be raised to an upright position as shown in FIG. 1, and can be folded by a folding angle 115 to a folded position as is shown in FIG. 2. The folding angle is arranged to be around 75 to 90 degrees. More preferred is around 90 degrees. The capturing mast comprises a main portion 101 and a hook portion 102, 103, 104, 106. When there is captured a cable, the foldable capturing mast folds and cable pulling forces and a mid section of the hook portion arranged with a hook angle 140 in relation to the main portion 101, forces the cable to travel towards a hook bend 102 of the foldable capturing mast. The cable 211, 212 now can be said to comprise two sections, a first section 211 extending from the mother ship to the hook bend 102 of the foldable capturing mast 105, and a second section 212 extending from the hook bend 102 of the foldable capturing mast 105 to the cable end with the connector 220. Due to the movement of the UUV 110 and of the mother ship, and according to hydrodynamics, there are forces pulling the cable section 211, 210 obliquely backwards in relation to UUV travelling direction 150. When a cable angle A between the first section 211, and the second section 212 becomes such that the cable 211 approaches (from the upper regions of the figure) a first guiding frame 120 and a second guiding frame 125. The first guiding frame 120 is designed as a flat arch 120 having a first and a second end, the first end being fastened to the UUV upper surface at a first point, and the second end of the first guiding frame is fastened to the UUV upper surface at a second point, farther aft than the first point, and in close proximity to the cradle, in order to let the cable slip towards the cradle. The first point of guiding frame 120 is preferably identical to a foremost point of same first guiding frame 120. The foremost point of guiding frame 120 should preferably be arranged fore of second guiding frame 125, and in height it should preferably be positioned at least half height of least diameter (width) of connector 220. In shown case approximately 60 millimeters and increasing as further aft and further away from the upper hull surface one gets. This will prevent the connector 220 from jumping over the first guiding frame 120 and escape in the direction of arrow 215.

The second guiding frame 125 is a tall arch with a first leg ascending to an apex, and a second leg descending from the apex to a first bend approximately at half of the height of the second guiding frame, and a third leg extending from the first bend approximately horizontally aftwards to a second bend and a third leg then bending downwards and there meeting and being attached to the cradle.

With this design, as the UUV moves forward, the first section 211 of the cable 211, 212, becomes guided towards the cradle and escapes at an open farther end of the cradle. At a point in time when the second section 212 of the cable 211, 212 become smaller and smaller it eventually flips around the foldable capturing mast 105 together with the connector 220.

Figure 2A:
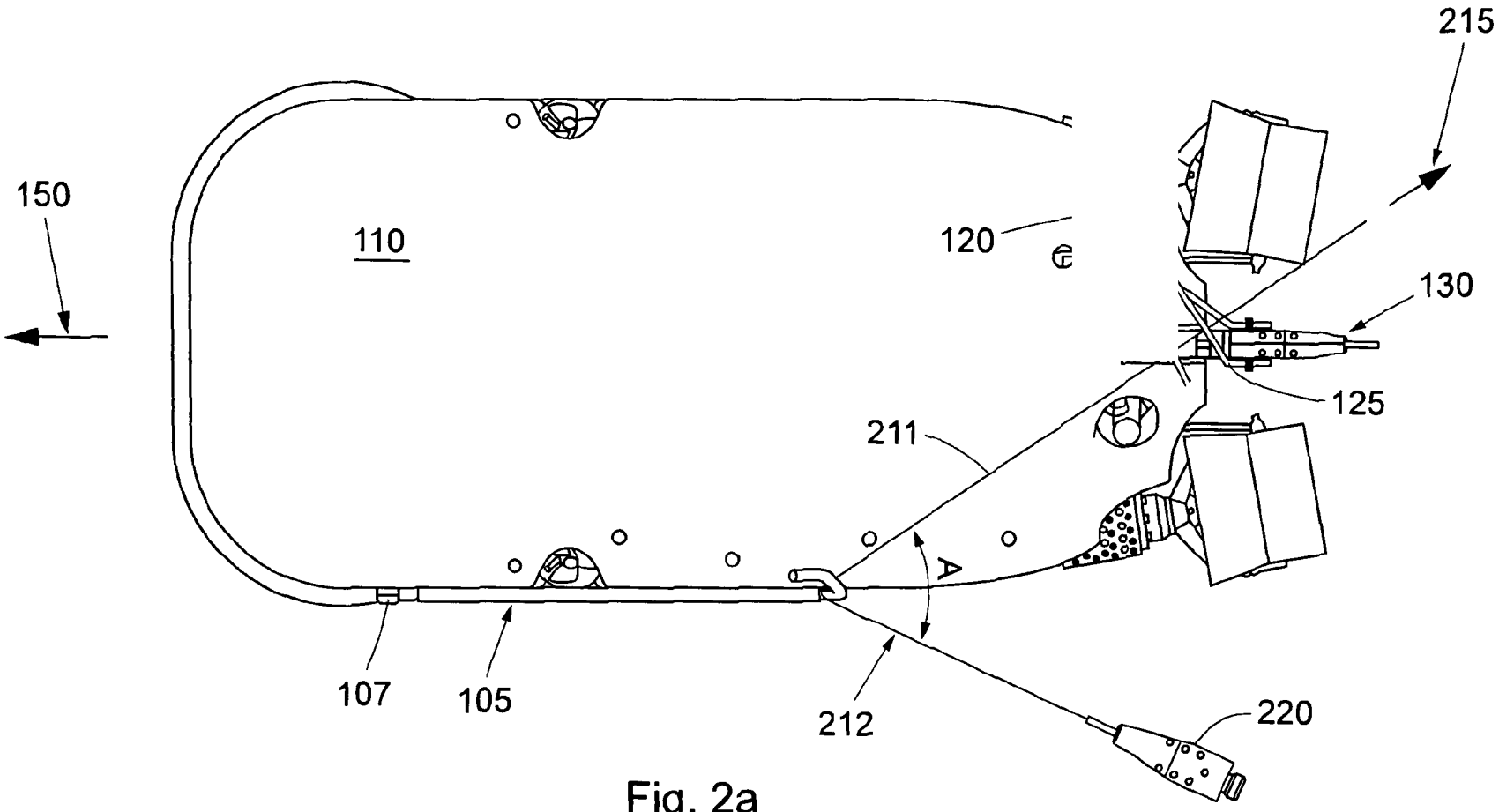
FIG. 2*a* shows a view from above of the UUV of FIG. 1.
Figure 2B:
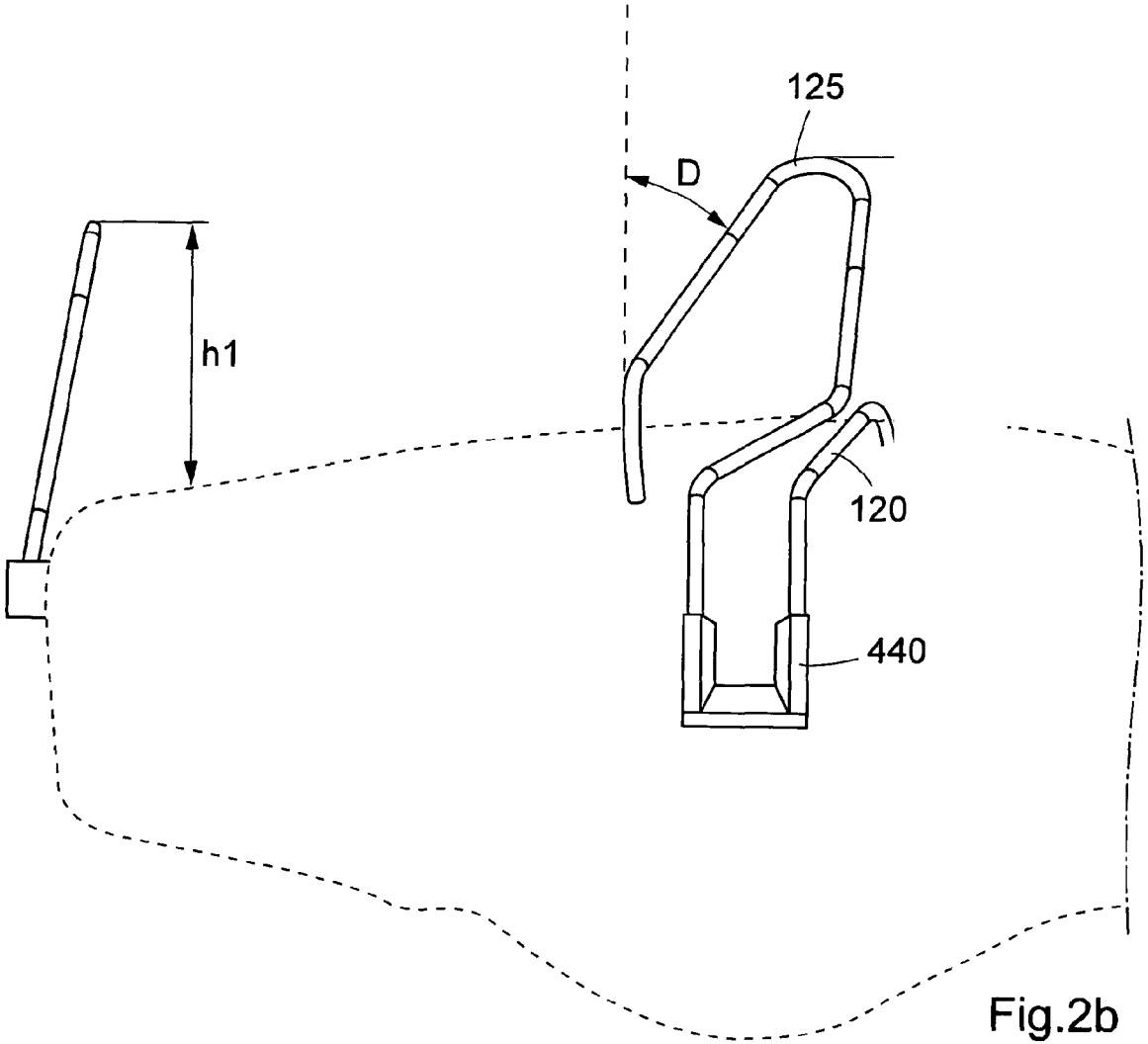
FIG. 2*b* shows an aft view of the UUV of FIG. 1
Figure 2C:
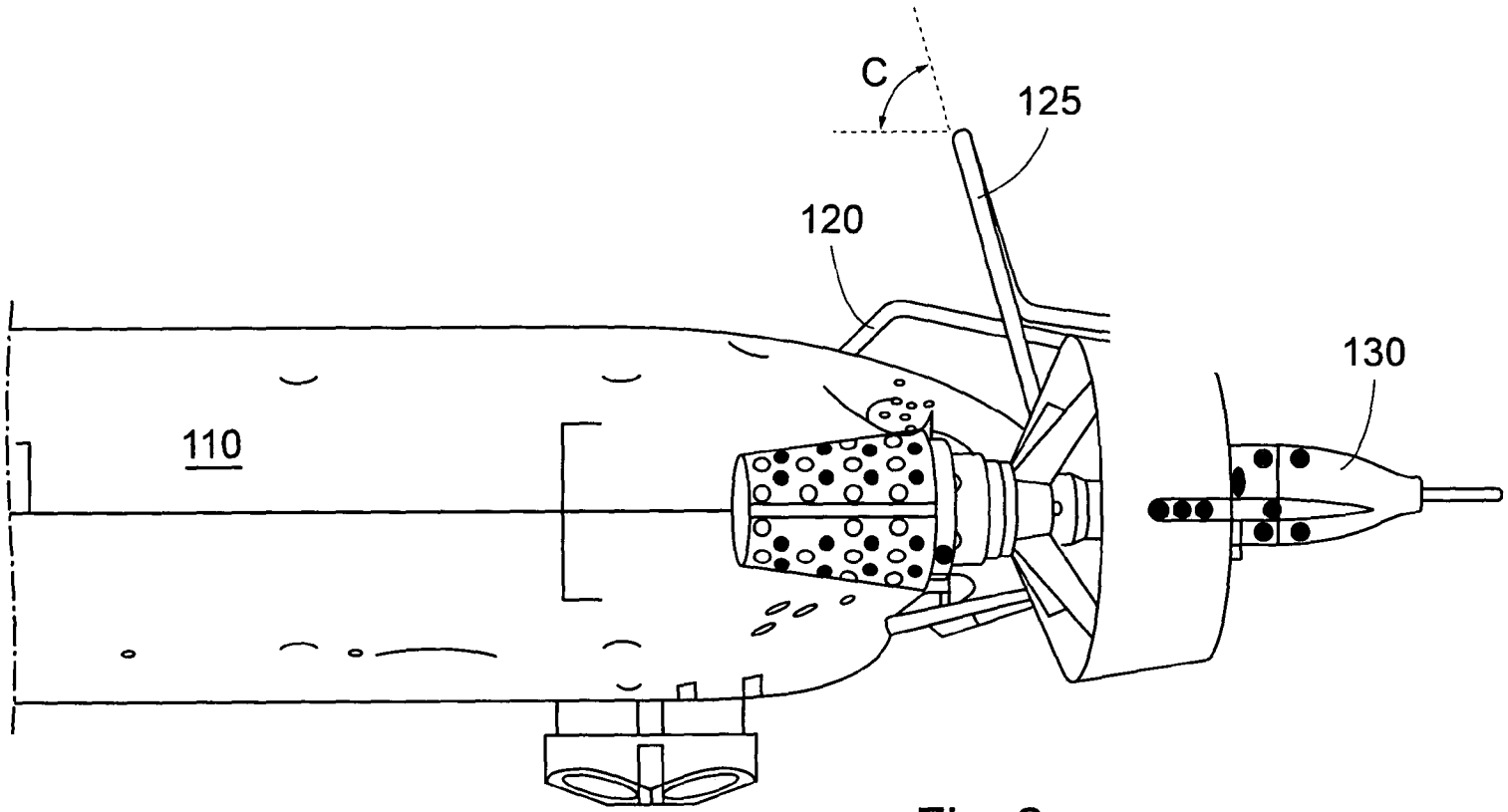
FIG. 2*c* shows an enlarged side view of the aft half portion of the UUV of FIG. 1
Figure 2D:
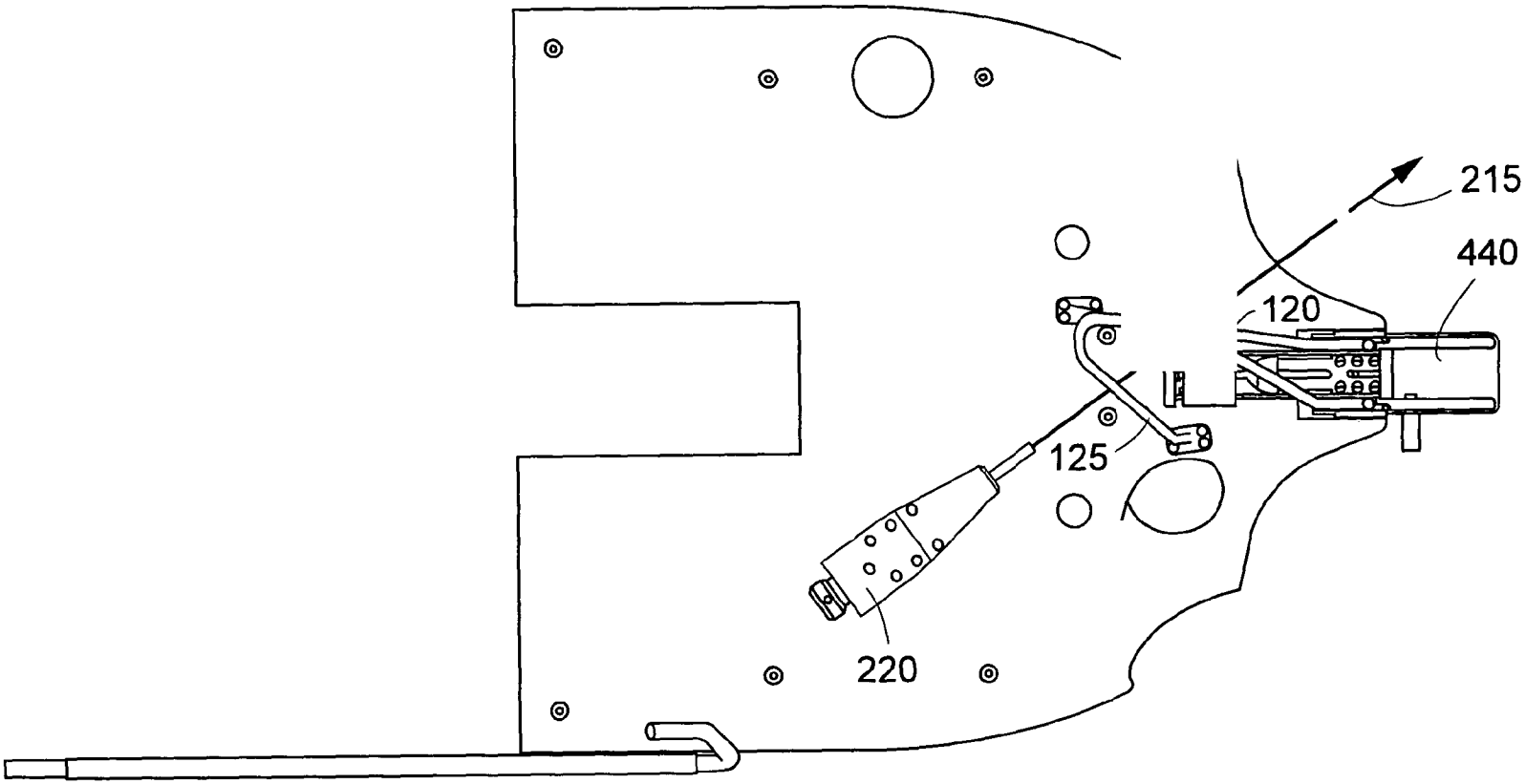
FIGS. 2*d-f* shows detailed views of the UUV at a certain moments of cable docking
Figure 2E:
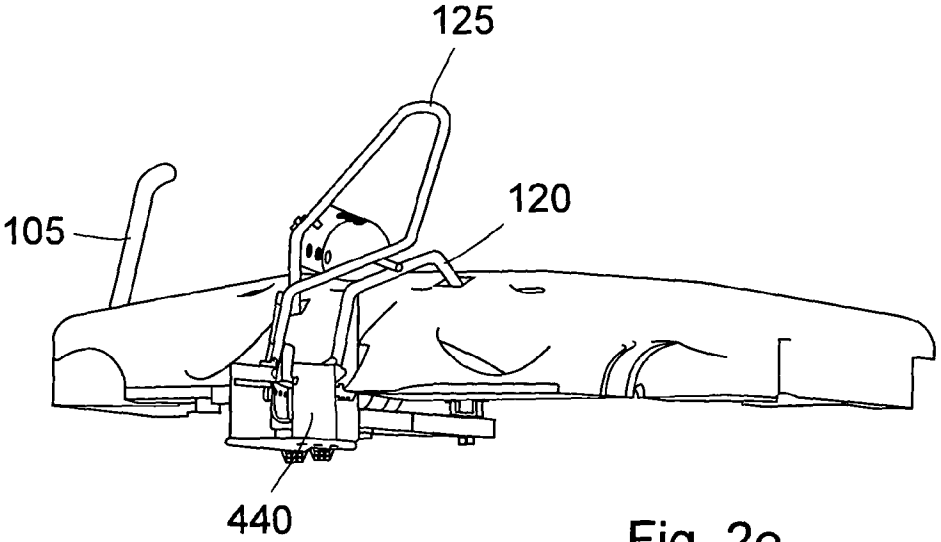
Figure 2F:
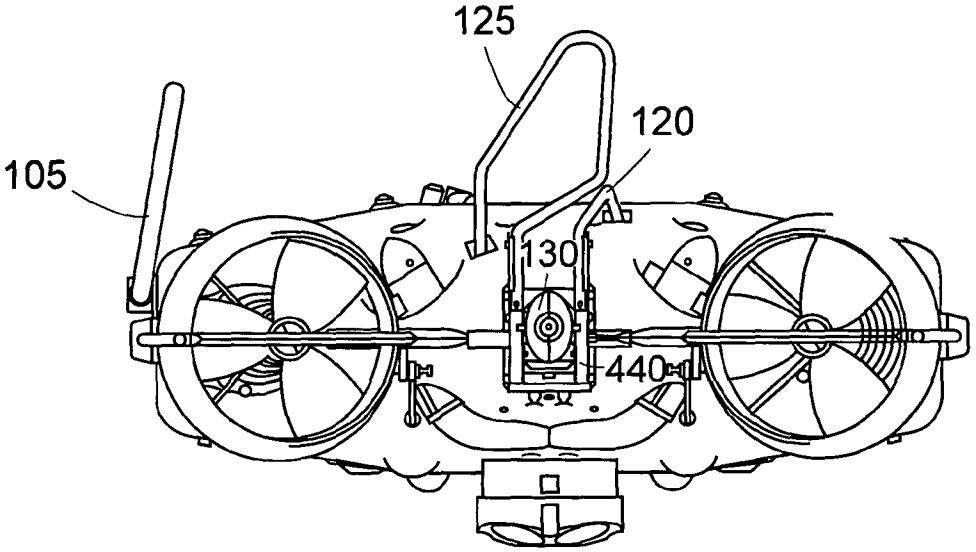

The purpose of the second guiding frame 125 is to, when mast 105 is folded; the cable 211 shall be guided between the first guiding frame 120 and the second guiding frame 125. If h2 is made to small or UUV is travelling at a too high speed, the cable may end up above the second guiding frame 125 and the connector 220 will continue in the direction of the arrow 215. As mentioned above, the dimensioning is a trade-off between permanent hydrodynamic resistance and the probability of successfully catching the cable and its connector at increasing speeds. A foot portion of the second guiding frame 125 that is joining the hull is preferably arranged as far aft as allowed by structural strength and geometry of UUV. This is to prevent the foot portion from disturbing the cable 211 and the connector 220 when it is to be catched by the guiding frames 120, 125. The angle marked C of the second guiding frame 125 in FIG. 2*c* is preferably as small as possible to prevent the cable from getting stuck on the second guiding frame and instead is forced in between second guiding frame 125 and first guiding frame 120. However, an uppermost point of the second guiding frame 125 must not be arranged too much forward since it then is necessary to arrange pivoting point 107 more forward, or make main portion 101 shorter.

The second section of the cable is thus guided through the cradle and when the connector is to pass the cradle it gets catched there because the cradle cross section is wider than the cable but smaller than the connector, and therefore lets the cable 211, 212 pass but not the connector 220. The connector in the catched position in the cradle is given reference number 130, for illustrative purposes. Subsequently, the catching of the connector 130, 220 is detected with suitable means, and the actuator is activated to press connectors together as mentioned above.

Considerations on Precise Position of Pivoting Point of Capturing Mast

The pivoting point 107 is arranged below an upper hull surface of the UUV. It is arranged lengthwise such that, when mast is folded, depending on the length of a main portion 101 of mast 105, the hook portion 102, 103, 104, 106, lands in a position such that the cable guided by the hook has a good chance of becoming captured and guided by the guiding frame 125. The longer the main portion of the mast, the longer forward on the UUV the pivoting point 107 should be arranged. It is also so that it is desired to have as low height of the guiding frame 125, i.e., the measure h2 in FIG. 2*b* should be low in order to keep hydrodynamic drag low. This is also true for the hook, i.e. the measure h1 of FIG. 2*b*. The height is preferably such that the connector 130, 220 is able to pass without getting jammed, and additionally the angle 140 of a first hook bend 102 is less than 90 degrees which entails that the mast in a folded position forces the cable towards the upper surface of the UUV hull.

Many parameters influence optimal position of pivoting point 107, length of the mast 105, and distance sideways between mast 105/hook 103 and guiding frames 120, 125. Among these parameters are velocity of UUV, and length of cable laid out from mother ship. An arrangement of cable catching elements based on said position of pivoting point, length of mast and sideways distance are restricted by the size of the UUV. It is undesirable to have an arrangement extending outside the length and width of UUV, and it should not extend too much in height in order to reduce hydrodynamic resistance when UUV is not catching cable. Disclosed embodiments have been tested in velocities of 1 to 3 knots with good results using laid out cable lengths of 50 meters and more. It is expected that during regular operation cable lengths of 300 to 800 meters will be used. It is advantageous to have connector 130 attached at an aft or aftmost position, because this will apply the cable drag force to the UUV straight backwards. Since these forces may be in the order of 300 kilograms, it would be difficult to manoeuvre the UUV if the force were applied at another position.

The guiding frames 120, 125 may preferably be of bent pipes, thereby reducing drag. The material could preferably be stainless steel, or of other sea-water resistant and strong material.

Rotating Means of First Embodiment

Figure 7A:
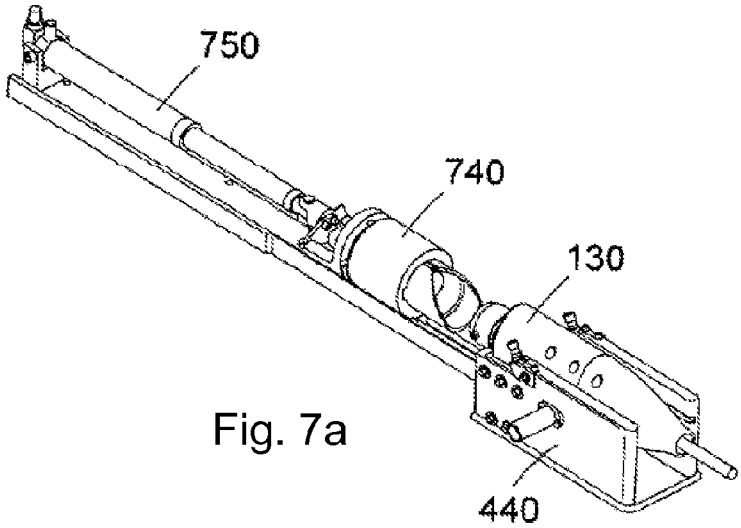
FIG. 7*a* shows a detailed view of the linear actuator and a connector of oval cross section.
Figure 7B:
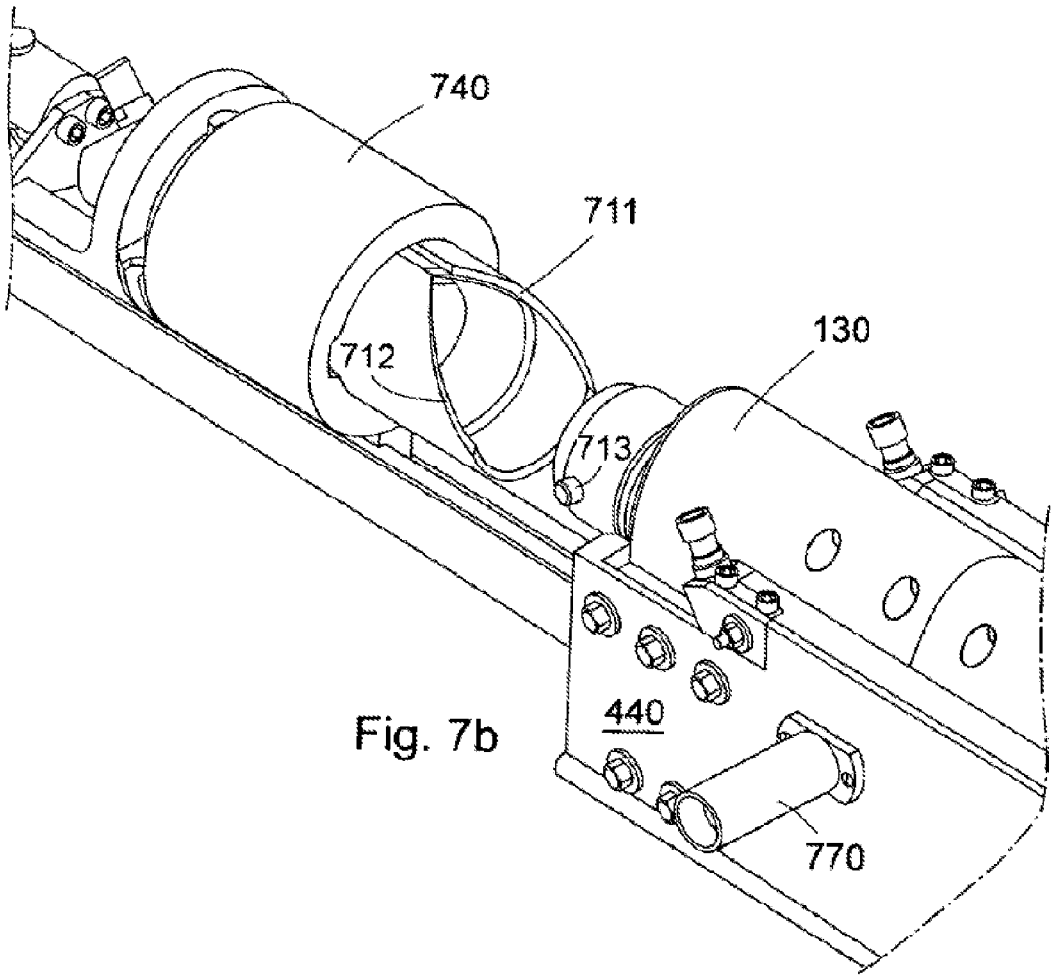
FIG. 7*b* shows a detailed view of a cam arrangement for turning the connector of the UUV into a position determined by a guiding pin of the connector of the cable.

The submersible vehicle 110 may further comprise rotating guiding means 711-713 at linear actuator 750 for rotating second connector 740 into position to be connected to first connector 130, see FIGS. 7*a*, and 7*b*. Suitable detection means 770 may be arranged to sense or detect that the connector 130 is safely in place in the cradle 440 in order to be connected. A pin or other mechanical protruding part 713 is arranged at the first connector 130 to cooperate with a first cam edge 711 or a second cam edge 712 attached to the second connector 740, such that corresponding contacts of the connectors' ends up straight in front of each other.

Second Embodiment

Figure 3:
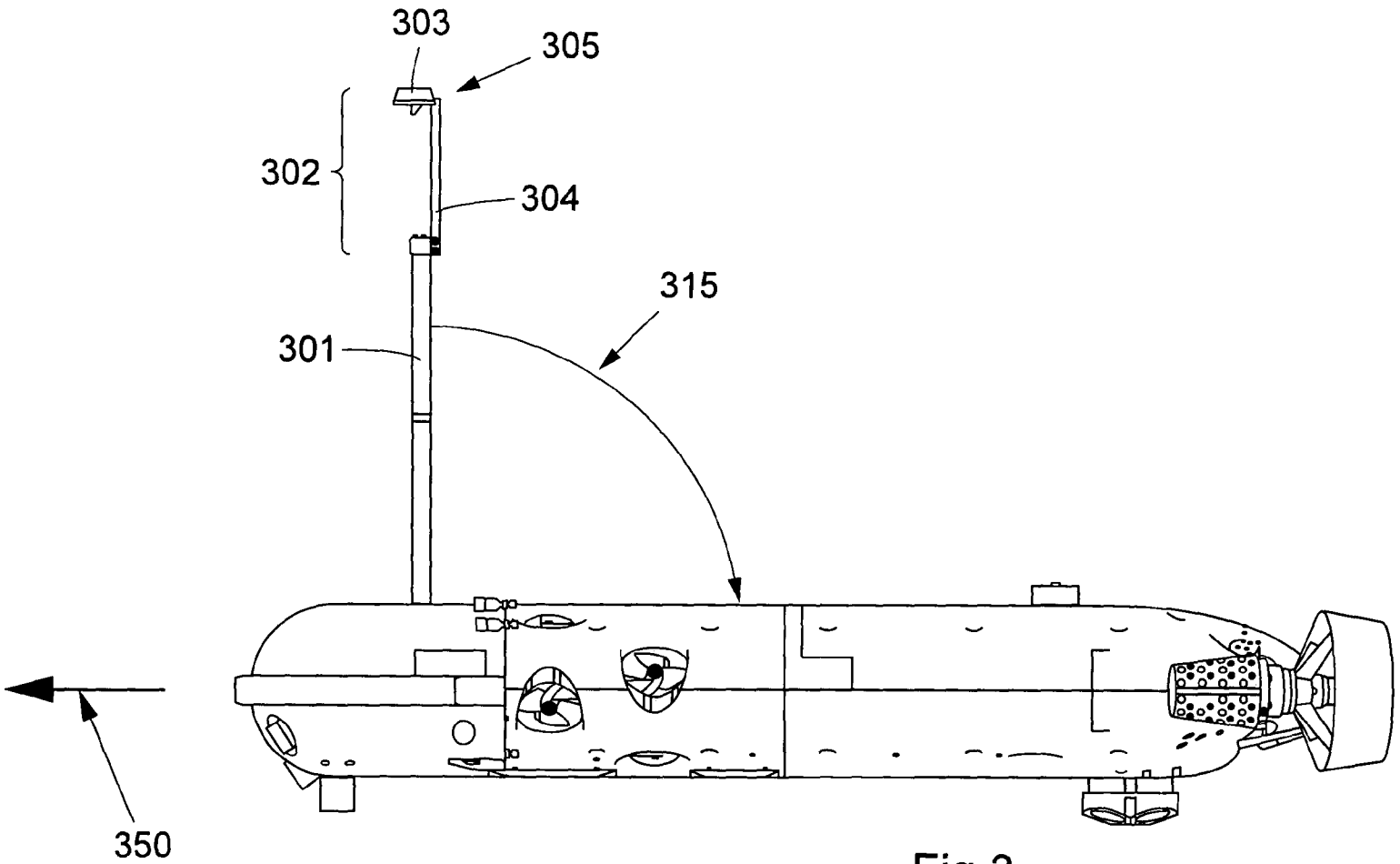
FIG. 3 shows a side view of an UUV with means according to a second embodiment, for capturing a towed cable and connecting to a connector at an end of said cable.

FIG. 3 shows a side view of an UUV 110 with means according to a second embodiment for capturing a towed cable and connecting to a connector at an end of said cable. A foldable capturing mast 305 is arranged to extend from a top surface of the UUV 110, and is foldable around a pivoting point 307 (not shown). The pivoting point 307 of capturing mast 305 is preferably arranged at a front third portion of the UUV to allow for portions 301 and 302 to show sufficient length. The length of portion 302 is longer than the connector 420, preferably at least 50 millimeters longer. The pivoting point is preferably arranged in a central third portion regarding its position in a port-starboard direction.

Figure 4:
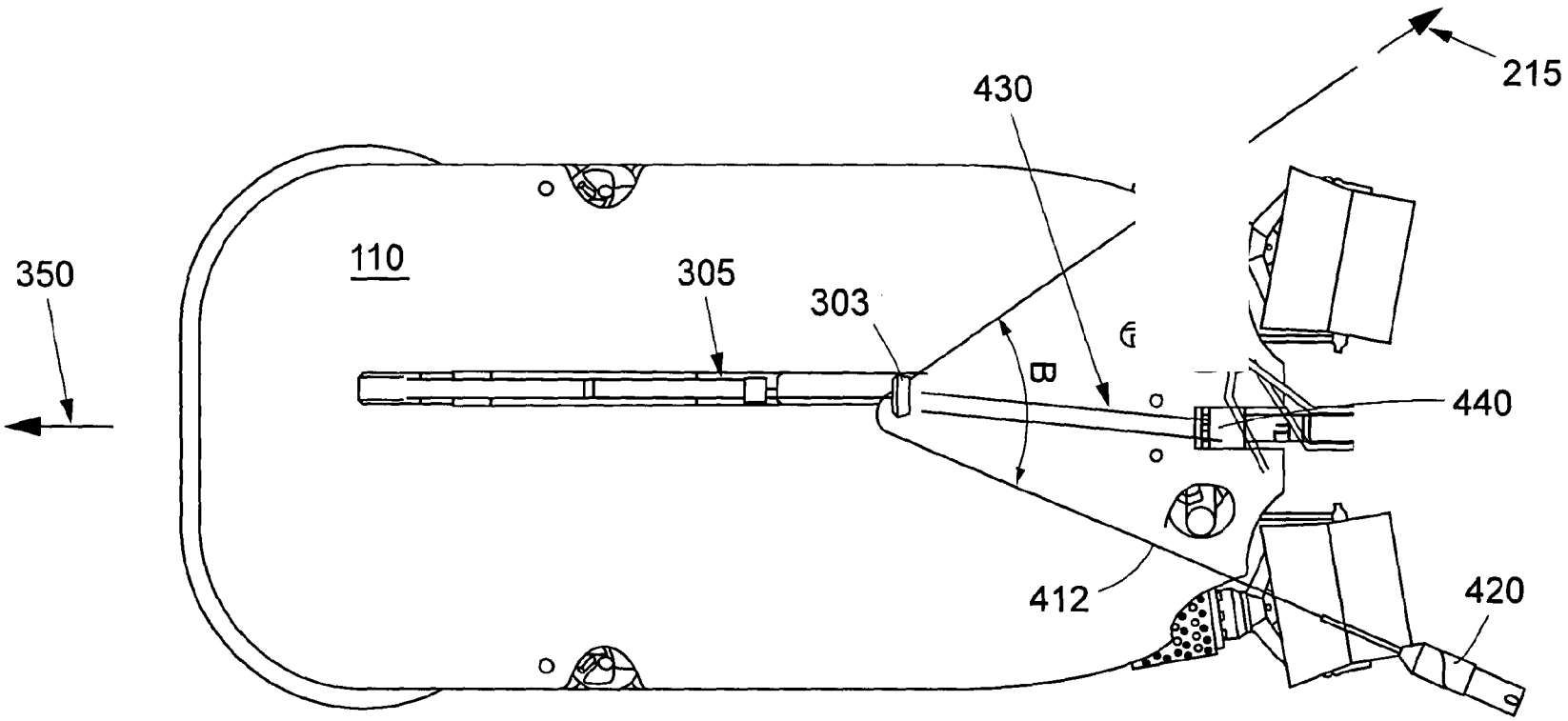
FIG. 4 shows a view from above of the UUV of FIG. 3.

The foldable capturing mast 305 can be raised to an upright position as shown in FIG. 3, and can be folded by a folding angle 315 to a folded position as is shown in FIG. 4. The folding angle is arranged to be around 90 degrees. Folding is arranged to occur when cable forces together with hydrodynamic forces exceeds a certain value, which value could be predetermined or made dependent on UUV speed. The capturing mast comprises a main portion 301 and a hook portion 302 including a hook organ 303. When there is captured a cable, the foldable capturing mast folds and cable pulling forces, forces the cable to travel towards the hook organ 303 of the foldable capturing mast 305. The cable 411, 412 now can be said to comprise two sections, a first section 411 extending from the mother ship to the hook organ 303 of the foldable capturing mast 305, and a second section 412 extending from the hook organ 303 of the foldable capturing mast 305 to the cable end with a connector 420. Due to the movement of the UUV 110 and of the mother ship, and according to hydrodynamics, there are forces pulling the cable section 411, 412 obliquely backwards in relation to UUV travelling direction 350.

Flipping of Connector

Figure 5:
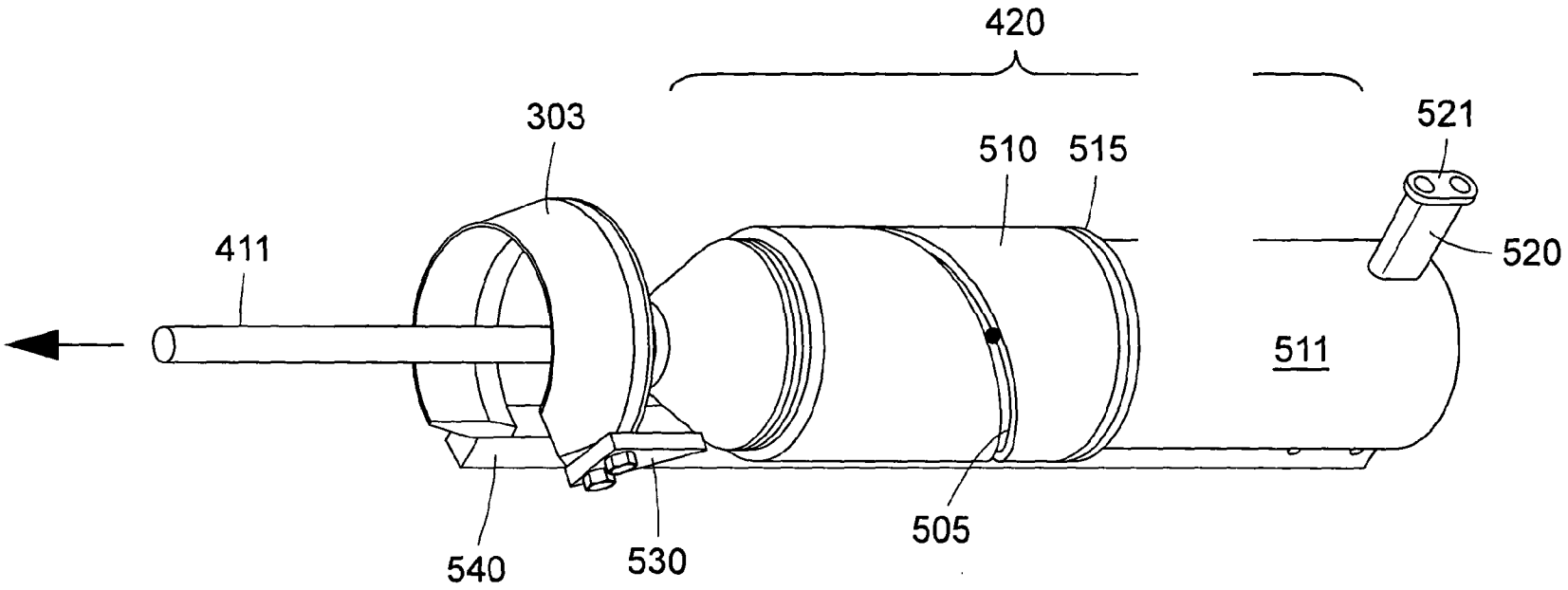
FIG. 5 shows a detailed view of a second embodiment of a capturing mast having captured a cylindrical connector.
Figure 6:
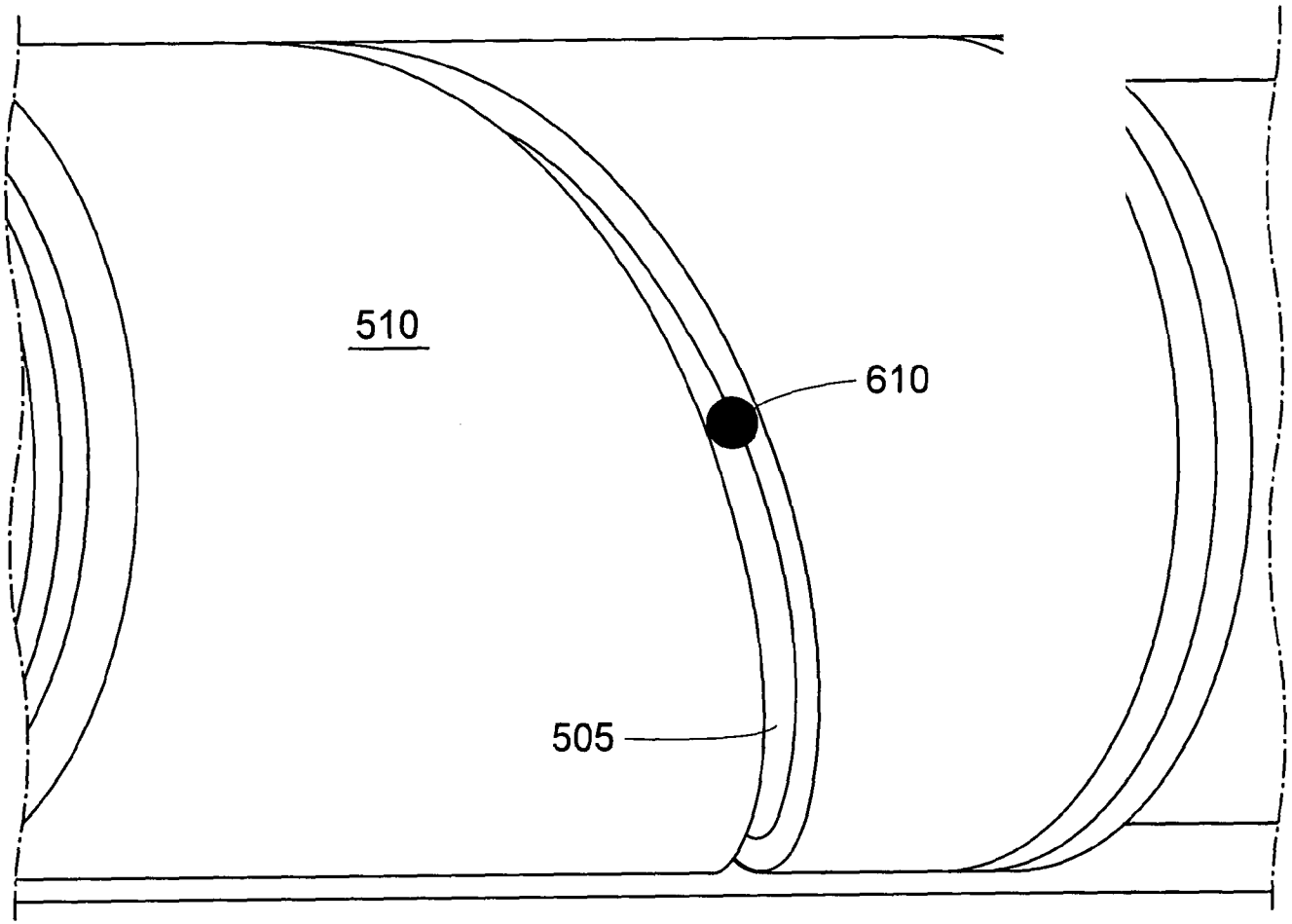
FIG. 6 shows an even more detailed view of the cylindrical connector of FIG. 5

The second cable section 412 becomes smaller and smaller as the cable slides through the hook organ 303, and eventually it comes to the cable end and the connector 420 flips around and gets catched in the hook organ 303. The detailed design of the hook organ 303 and the connector 420 and how they cooperate will be explained further with reference to FIG. 5. The hook organ 303 is preferably shaped as a non-closed ring 303. The ring 303 has a predetermined inner diameter which is adapted to an outer diameter of a tubular casing 510 of the connector 420 in that a tubular casing 510 of the connector 420 narrowly passes through the hook organ 303 but gets hung up by a spring ring 515. The tubular casing 510 is provided with a helical groove 505. There is provided, at ring 303, an abutment 530 that prevents the tubular casing 510 from rotating and also from translational movement. The connector body 511 is provided with a pin 610 that fits movably in the helical groove 505. The pin 610 of the connector body and the helical groove 505 of the tubular casing is arranged to cooperate in that the pin 610 of the connector body 511 of connector 420 is guided by the helical grove of the tubular casing 510 such that the connector body 511 begins to turn when the cable section 411 pulls the connector 420 and continues to turn until a keel 520 of the connector body 511 makes contact with rod portion 540 of hook portion 302 of the mast. The connector body 511, which encompasses the electrical contacts, in this way becomes in a predefined rotational position, when the keel 520 faces downwards.

Bringing Connector to Connecting Position

The spring ring 515 of the tubular casing 510 is devised to give at a predetermined, higher amount of force, and the connector 420 can continue further, guided by a rail 430 for the keel 520, down to a connecting position, i.e. to the cradle 440, where the UUV connector is to be connected with the aid of a linear actuator. The rail 430 and the keel 520 are devised such that when the keel has entered the rail, it will not come into a lock before it has moved into the connecting position, i.e. into the cradle 440. The keel 520 is provided with a derailing guard 521 for preventing the keel 520 from undesirably leaving the rail 430 during the connector's travel to the cradle 440.

Thus, when the connector is catched in the hook organ 303, this is sensed by first suitable detection means and the hook portion 302 is extended towards the cradle 440. There are arranged rails 430 for guiding the hook portion with the connector 420 towards the cradle 440. When the connector is safely in place in the cradle this is detected with second suitable detection means, and an actuator is activated to press connectors together in the same way as mentioned above, establishing an electrical connection between the UUV 110 and the mother ship.

The connector 420 is preferably provided with a spring ring 515 for re-turning the tubular casing 510 to it original position where it will be ready to repeat its task at a new connection operation.

The invention claimed is:

1. A submersible vehicle, comprising:

a connector configured to connect the submersible vehicle to a cable in water, the connector comprising a first free cable end including a first connector arranged at the free cable end and facing away from the cable;

an upright arm comprising a hook portion arranged at an end of the upright arm distal to the submersible vehicle, wherein the upright arm is foldable from an upright position extending away from a surface of the submersible vehicle to a folded position substantially parallel to the surface of the submersible vehicle;

a first guide, wherein the upright arm is adapted to capture the cable and guide the cable towards the first guide; and a connector holder configured to hold the first connector in a position to be connected to a second connector, wherein the first guide is adapted to guide the first connector towards the connector holder.

2. The submersible vehicle according to claim 1, further comprising:

a second guide configured to turn the connector to a predefined position into the connector holder.

3. The submersible vehicle according to claim 1, wherein the upright arm is moveable.

4. The submersible vehicle according to claim 1, wherein the first guide comprises a guiding frame comprising a first guiding frame designed as a flat arch, and a second guiding frame designed as a tall arch.

5. The submersible vehicle according to claim 2, wherein the second guide comprises a guiding frame comprising a cam edge arranged to cooperate with a protruding part of the first connector.

6. The submersible vehicle according to claim 1, further comprising:

a linear actuator arranged at an outside of the submersible vehicle for linearly moving the second connector towards the first connector to establish connection between the mother ship and the submersible vehicle.

7. The submersible vehicle according to claim 1, further comprising:

a capturing mast arranged at a distance from a longitudinal midline of the submersible vehicle and at a front half portion of the submersible vehicle.

8. The submersible vehicle according to claim 1, wherein the first guide is arranged near a horizontal midline and at a rear half portion of the submersible vehicle.

9. The submersible vehicle according to claim 7, wherein the submersible vehicle has an upper side mainly free of protruding objects except for the capturing mast and the first guide and the second guide.

10. The submersible vehicle according to claim 4, wherein the first guide comprises a first member and a second member, the first member being arranged to guide the cable downwards and sideways towards the second guiding frame, and the second member being arranged to guide the cable mainly in sideways direction towards the second guiding frame.

11. The submersible vehicle according to claim 7, further comprising:

a hook organ arranged at a top portion of the capturing mast.

12. The submersible vehicle according to claim 11, wherein the hook organ is partly ring shaped for surrounding the cable, and has an opening for letting the cable into a space defined by the hook organ.

13. The submersible vehicle according to claim 11, wherein the hook organ is a principally a straight member arranged with an angle towards a main portion of the mast.

14. The submersible vehicle according to claim 1, wherein the connector holder designed as a cradle.

15. The submersible vehicle according to claim 14, wherein the cradle has a cross section that is wider than the cable but narrower than the first connector.

16. A system for interconnecting a mother ship with a submersible vehicle, using a cable towed by the mother ship, the cable having a first cable end connected to the mother ship, and a second free cable end, the second cable end being provided with a first connector facing away from the cable, the system comprising:

an upright arm comprising a hook portion arranged at an end of the upright arm distal to the submersible vehicle, wherein the upright arm is arranged at the submersible vehicle for capturing the cable towed by the mother ship, and wherein the upright arm is foldable from an upright position extending away from a surface of the submersible vehicle to a folded position substantially parallel to the surface of the submersible vehicle;

a connector holder being arranged at the submersible vehicle for holding the first connector in a position to be connected to a second connector, the second connector being connected to the submersible vehicle;

a first guide arranged at the submersible vehicle and configured to guide the first connector towards the connector holder of the submersible vehicle; and a second guide for turning the connector to a connection position into the connector holder.

17. A method for connecting a towed cable to a submersible vehicle, the cable having a first cable end connectable to an entity, and a second cable end, the second cable end being provided with a first connector facing away from the cable, the method comprising:

capturing the cable with aid of an upright arm arranged at the submersible vehicle, wherein the upright arm is foldable from an upright position extending away from a surface of the submersible vehicle to a folded position substantially parallel to a surface of the submersible vehicle, and wherein the upright are comprises a hook portion arranged at an end of the upright arm distal to the submersible vehicle;

guiding the cable towards a first guide with aid of the upright arm;

guiding the first connector towards a connector holder of the submersible vehicle with the aid of first guide;

holding the first connector with aid of the connector holder, wherein the holder is adapted to hold the first connector firmly in a predefined position where the first connector can be connected to a second connector, the second connector being connected to the submersible vehicle; and moving the second connector towards the first connector.

18. The method according to claim 17, further comprising:

turning the connector to a predefined position into the connector holder.

19. A submersible vehicle, comprising:

a connector configured to connect the submersible vehicle to a cable in water having a first free cable end with a first connector arranged at the free cable end and facing away from the cable;

an upright arm comprising a hook portion arranged at an end of the upright arm distal to the submersible vehicle, wherein the upright arm is foldable from an upright position extending away from a surface of the submersible vehicle to a folded position substantially parallel to the surface of the submersible vehicle;

a first guide, wherein the upright arm is adapted to capture the cable and guide the cable towards the first guide;

a connector holder configured to hold the first connector in a position to be connected to a second connector, wherein the first guide is adapted to guide the first connector towards the connector holder; and a linear actuator arranged at the outside of the submersible vehicle for linearly moving the second connector, towards the first connector to establish connection between the mother ship and the submersible vehicle.

* * * * *

UNITED STATES PATENT AND TRADEMARK OFFICE

CERTIFICATE OF CORRECTION

PATENT NO. : 8,622,014 B2
APPLICATION NO. : 13/145818
DATED : January 7, 2014
INVENTOR(S) : Lundberg It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 139 days.

Signed and Sealed this
Twelfth Day of May, 2015

Michelle K. Lee

Michelle K. Lee
*Director of the United States Patent and Trademark Office*